US006250249B1

(12) United States Patent
Yang

(10) Patent No.: US 6,250,249 B1
(45) Date of Patent: Jun. 26, 2001

(54) BOOK MARKER

(76) Inventor: Gai Wai Yang, 2880 Chaseway Dr., Ann Arbor, MI (US) 48105

( * ) Notice: Subject to any disclaimer, the term of this patent is extended or adjusted under 35 U.S.C. 154(b) by 0 days.

(21) Appl. No.: 09/387,920

(22) Filed: Sep. 1, 1999

(51) Int. Cl.[7] ..... B42D 9/00

(52) U.S. Cl. ..... 116/234; 116/237; 24/332; 24/509

(58) Field of Search ..... 116/234, 237, 116/238, 239; 281/42, 45; 24/331, 332, 329, 509

(56) References Cited

U.S. PATENT DOCUMENTS

| | | | | |
|---|---|---|---|---|
| 432,038 | | 7/1890 | Harding . | |
| 472,247 | | 4/1892 | Baker, Jr. . | |
| 799,775 | | 9/1905 | Budge . | |
| 1,345,216 | * | 6/1920 | Narbett | 24/331 |
| 1,663,307 | | 3/1928 | Jackson . | |
| 1,700,846 | | 2/1929 | Klein . | |
| 1,805,732 | | 5/1931 | Dittmann . | |
| 2,116,147 | | 5/1938 | Haessler . | |
| 2,328,811 | | 9/1943 | Kardoff . | |
| 2,344,613 | | 3/1944 | Hellstern . | |
| 2,408,145 | * | 9/1946 | Johnson | 24/332 |
| 2,483,303 | * | 9/1949 | Rysick | 24/332 |
| 2,631,560 | | 3/1953 | Myers . | |
| 2,780,481 | | 2/1957 | Green . | |
| 3,381,654 | | 5/1968 | Hupp et al. . | |
| 5,570,907 | * | 11/1996 | Dromi et al. | 281/45 |
| 5,697,594 | * | 12/1997 | Adams et al. | 24/331 |
| 5,863,021 | * | 1/1999 | Nichols | 24/332 |
| 6,101,689 | * | 8/2000 | Jo | 24/332 |

FOREIGN PATENT DOCUMENTS

| | | | | |
|---|---|---|---|---|
| 181173 | * | 2/1907 | (DE) | 24/332 |
| 141744 | * | 5/1935 | (DE) | 24/331 |

* cited by examiner

*Primary Examiner*—Andrew H. Hirshfeld
(74) *Attorney, Agent, or Firm*—Young & Basile, P.C.

(57) ABSTRACT

A book marker is disclosed which comprises at least first, second, and third jaw members, the first and second jaw members being hingedly connected at a common pivotal axis to define a first independently operable clamp selectively positionable between clamped and unclamped positions thereof, and the second and third jaw members being hingedly connected at a common pivotal axis to define a second independently operable clamp selectively positionable between clamped and unclamped positions thereof.

10 Claims, 2 Drawing Sheets

BOOK MARKER

FIELD OF THE INVENTION

The present invention relates generally to book markers, and more particularly to a book marker having a two or more selectively independently operable clamps for securing in place separate pages, or multiples of pages, in a single book.

BACKGROUND OF THE INVENTION

Book marks are well known, and in their simplest form, which almost certainly dates back to the earliest books, comprise a length of fabric, such as ribbon, which rests between the leaves of a book. Since the days of these simplest of book marks, numerous improvements and modifications have been made.

One common need among bibliophiles is the ability to simultaneously mark or identify several places in a single book. For instance, it is often expedient to know the location in a book of the end of a chapter currently being read, as well as the reader's current place in the book preceding that chapter's end. Notwithstanding the various improvements embodied in the prior art, however, there continues to exist the need for a simple and efficient book marker which can be economically manufactured and which will avoid the failings associated with prior art book marks, while providing for the securement of multiple pages, or collections of pages, in a single book.

SUMMARY OF THE INVENTION

The objects and advantages of the present invention are accomplished by a book marker comprising at least first, second, and third jaw members, the first and second jaw members being hingedly connected at a common pivotal axis to define a first independently operable clamp selectively positionable between clamped and unclamped positions thereof, and the second and third jaw members being hingedly connected at a common pivotal axis to define a second independently operable clamp selectively positionable between clamped and unclamped positions thereof. According to this arrangement, the second jaw member is intermediate of the first and third jaw members such that each of the first and second clamps comprise a pair of jaws including the second jaw member and one of the first or third jaw members.

According to one feature of this invention, means are provided for independently selectively actuating the first and second clamps between the clamped and unclamped positions thereof.

According to another feature of this invention, the first and second clamps are biased towards the clamped positions thereof, for example by a spring or other suitable biasing means.

According to yet another inventive feature, the common pivotal axis between the first and second jaw members, and the common pivotal axis between the second and third jaw members, comprise separate pivotal axes which are offset relative to each other. According to this feature, the means for independently selectively actuating the second clamp are positioned relative to the pivotal axis between the first and second jaw members so that actuation of the second clamp does not simultaneously actuate the first clamp.

DESCRIPTION OF THE ILLUSTRATED EMBODIMENT

Figure 1:
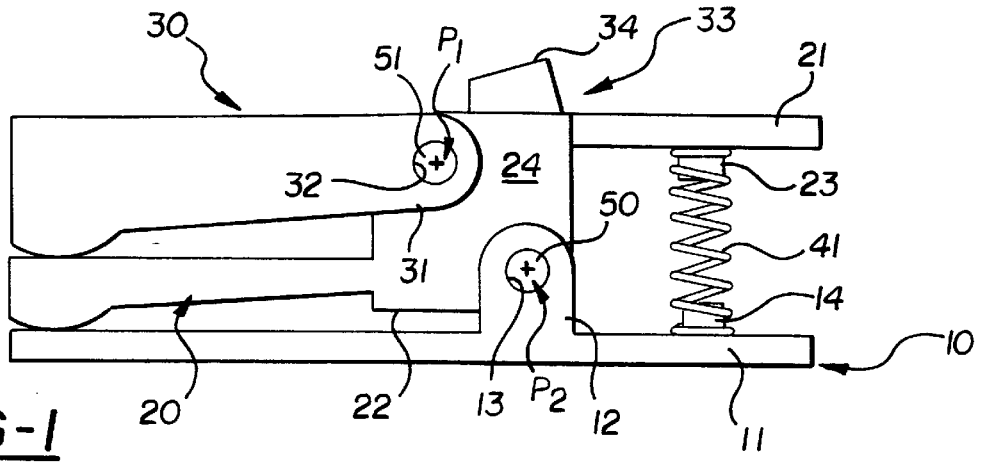
FIG. 1 is a lateral view of the book marker of the present invention, shown with the clamps thereof in their closed positions.
Figure 2A:
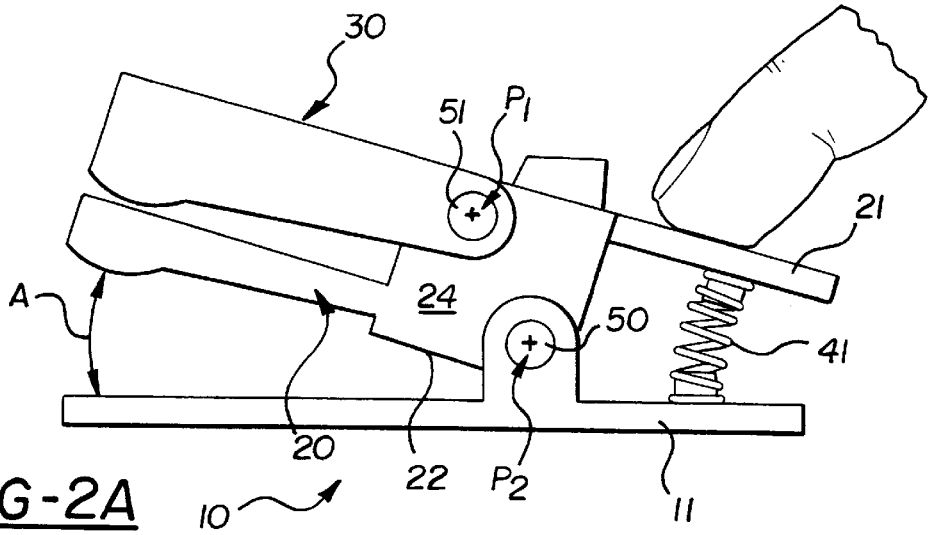
FIG. 2A is a lateral view of the book marker of FIG. 1, shown with one of the clamps thereof in its opened position.
Figure 2B:
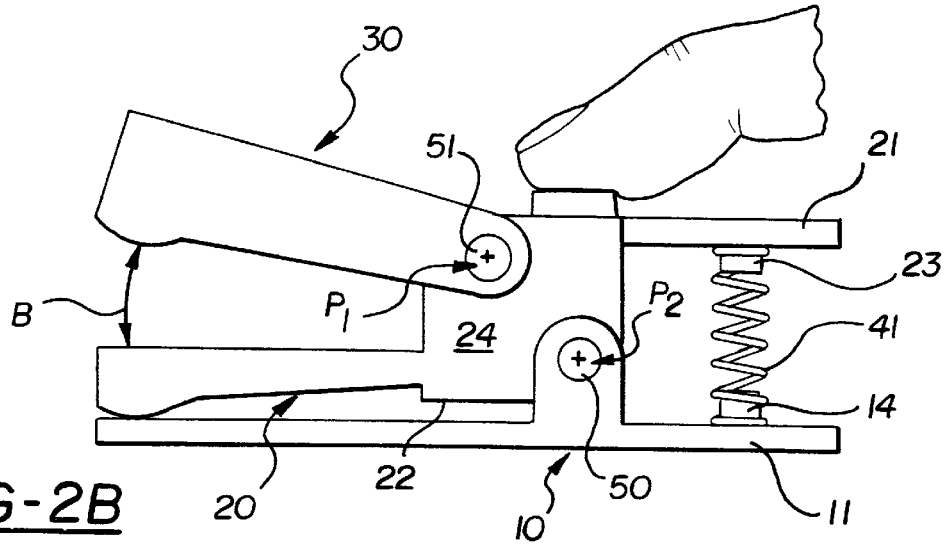
FIG. 2B is a lateral view of the book marker of FIG. 1, shown with the other of the clamps thereof in its opened position.

Referring first to FIGS. 1 and 2A–2B, the present inventive book marker will be seen to most generally comprise a first pair of directly hingedly connected first 10 and second 20 jaw members, and at least a third jaw member 30 hingedly connected to the jaw member 20. The second jaw member 20 is intermediate the first 10 and third 30 jaw members such that the jaw member 10 defines a first clamp A in conjunction with the second jaw member 20 (FIG. 2A), and the jaw member 20 further defines a second clamp B in conjunction with the third jaw member 30 (FIG. 2B).

Figure 3:
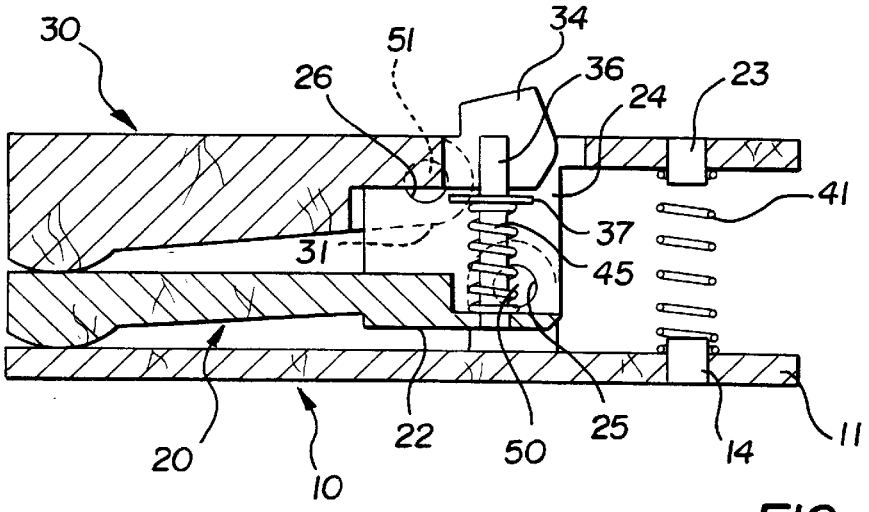
FIG. 3 is a cross-sectional view of the book marker of the present invention, taken along lines III of FIG. 1.

The clamps A and B are preferably biased towards clamped positions thereof (FIG. 1) by suitable biasing means, for example the illustrated coil springs 41, 45 (FIG. 3). Other biasing means are also contemplated by this invention, it being appreciated from the remainder of this disclosure that virtually any known means for urging the jaws of the clamps towards their clamped positions can be substituted according to user desires or needs.

In the illustrated form of this invention, the book marker is shown as being fabricated from wood. However, it will be appreciated from the remainder of this disclosure that the invention is not limited by the material of its manufacture, and may instead be fabricated from any desired material and according to any known method of manufacture.

Figure 4:
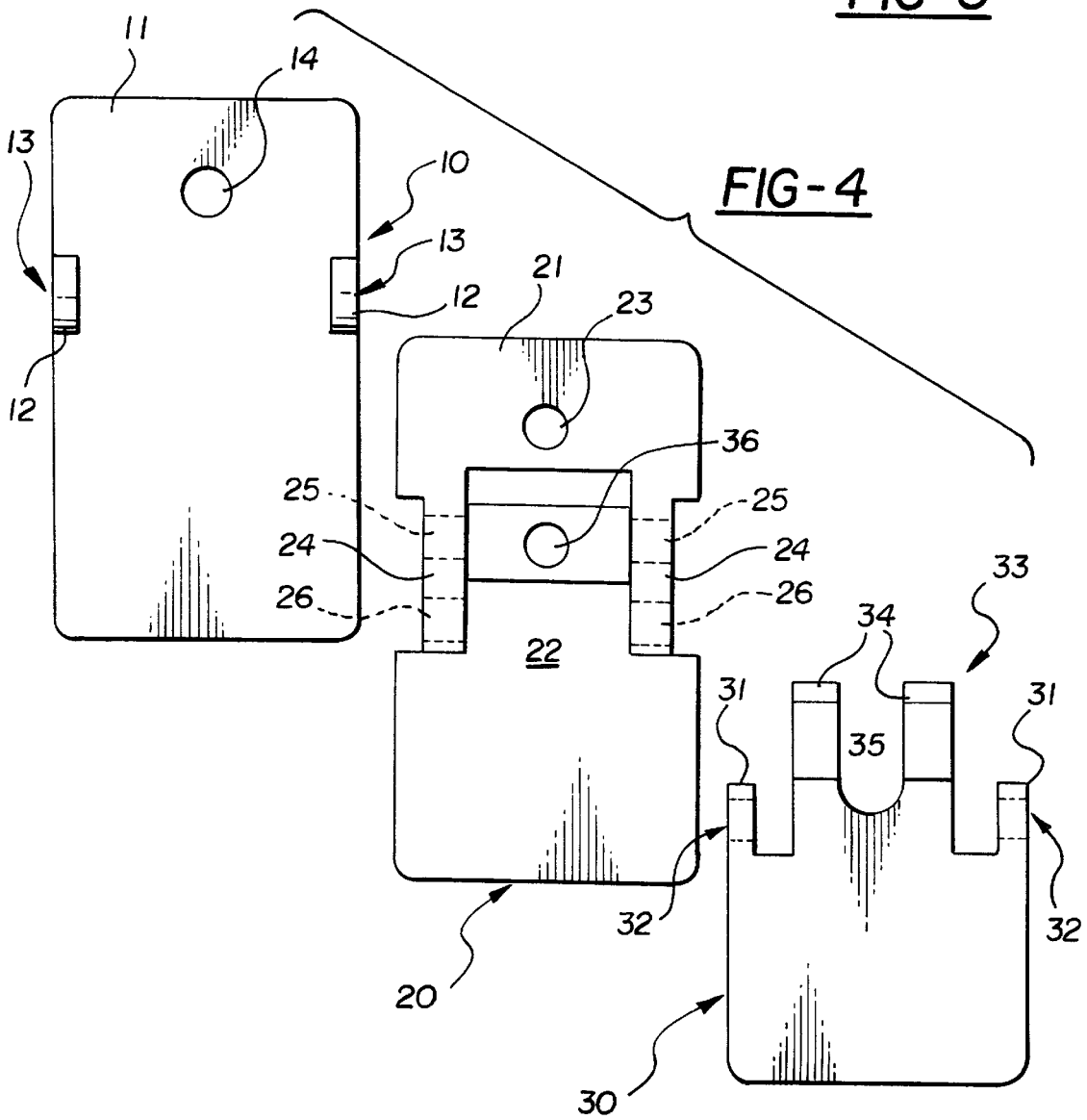
FIG. 4 depicts in elevation the various jaw members of the book marker of the present invention in a disassembled condition.

As shown in FIGS. 1, 3, and 4, the first jaw member 10 of the illustrated embodiment comprises a generally planar, rectangularly-shaped element including a tab portion 11 defined generally by the area of the jaw member 10 extending away from a pair of centrally disposed, upwardly projecting sidewall portions 12. A jaw portion of the jaw member 10 is defined generally by the area at the opposite end of the jaw member 10. Each sidewall portion 12 includes a bore 13 therethrough dimensioned to receive one of two pivot pins 50 for hingedly connecting the jaw members 10 and 20. A pin 14 projecting upwardly from the tab portion 11 serves as a mount for the biasing spring 41. Those of skill will of course appreciate from the remainder of this disclosure that the overall dimensions and geometry of first jaw member 10, as well as the other jaw members 20, 30 described herein, are subject to modification according to user desire or needs, and are not limiting of the present invention. Thus, for instance, the book marker of this invention may be fashioned in virtually any desirable and pleasing shape, subject only to the restriction that the book marker so fashioned comprise at least first, second, and third jaw members, the first and second jaw members hingedly connected at a common pivotal axis to define a first independently operable clamp selectively positionable between clamped and unclamped positions thereof, and the second and third jaw members hingedly connected at a common pivotal axis to define a second independently operable clamp selectively positionable between clamped and unclamped positions thereof.

Still referring to FIGS. 1, 3, and 4, the second jaw member 20 is disposed generally intermediate jaw members 10 and 30 in the assembled book marker. Jaw member 20 is of approximately the same longitudinal and transverse dimensions as the jaw member 10, but is characterized by a generally "S"-shape profile defined by a tab portion 21 projecting away from a central body portion 22 in a first direction, and the jaw portion of the jaw member 20 projecting oppositely, and vertically lower, from the central body portion 22. The tab portion 21 is generally opposed to the tab portion 11 of the jaw member 10. In combination, these tab portions 11, 21 define means for manually actuating the clamp A between the clamped and unclamped positions thereof, as shown in FIG. 2A. A pin 23 projecting downwardly from and opposing the pin 14 serves as a mount for an end of the biasing spring 41. Referring particularly to FIGS. 3 and 4, the central body portion 22 defines a generally "U"-shape in transverse section, including opposing side wall portions 24 from which the tab portion 21 extends. Each side wall portion 24 includes a pair of bores 25, 26 therethrough in coaxially alignment with the bores on the opposing side wall 24. The two pairs of bores 25, 26 are dimensioned to receive the pairs of pivot pins 50, 51 which hingedly connect the jaw members 10, 20, and 30.

Still referring to FIGS. 1, 3, and 4, the third jaw member 30 is characterized by similar transverse dimensions as the jaw members 10 and 20, but has, in the illustrated embodiment, a shorter overall length. The jaw member 30 includes a pair of opposed projecting elements 31 (shown in phantom in FIG. 3), each such projecting element 31 including a bore 32 therethrough, the pair of boxes 32 in coaxial alignment. These bores 32 are dimensioned to each receive one of the pair of pivot pins 51 therethrough. Interiorly of the projecting elements 31 is provided a tab portion 33 for manual actuation of the second clamp B between the clamped and unclamped positions thereof. In the illustrated embodiment, the tab portion 33 comprises a pair of upwardly extending projections 34 defining a channel 35 therebetween (FIG. 4). Referring particularly to FIG. 3, a pin 36 projects upwardly from the central body portion 22 into the channel 35 between projections 34, the pin 36 serving as a mount and guide for the biasing means, such as the illustrated coil spring 45, which acts to bias the second clamp B towards the clamped position thereof. Preferably, the channel 35 is of sufficient dimensions that the pin 36 does not interfere with hinged movement of the third jaw member 30 relative to the second jaw member 20. Stop means such as the illustrated washer 37 are provided, according to the illustrated embodiment, between the underside of the tab portion 33 and an end of the spring 45, the stop means providing a sufficient contact surface for the end of the spring 45 proximate the jaw member 30 to thereby prevent the spring 45 from inadvertently passing through the channel 35. Of course, other biasing means may be substituted for those illustrated here.

Referring now to FIGS. 1 and 3 in particular, the interrelation of the jaw members 10, 20, and 30 will be better understood. Specifically, the first jaw member 10 is hingedly connected to the central body portion 22 of the second jaw member 20 by means of the pivot pins 50 extending through the opposing pairs of coaxial bores 13, 25; the third jaw member 30 is hingedly connected to the central portion 22 of the jaw member 20 by means of the pivot pins 51 extending through the opposing pairs of coaxial bores 26, 32. The previously described arrangement of the springs 41 serves to bias the first clamp A, comprising jaw members 10, 20, towards the clamped position thereof; the arrangement of spring 45 serves to bias the second clamp B, comprising jaw members 20, 30, towards the clamped position thereof.

According to the foregoing arrangement, it will be appreciated that operation of the first clamp A, by manually urging the tab portions 11, 21 toward each other, will simultaneously effect radial movement of the jaw member 30, though the second clamp B will remain in its clamped position. (FIG. 2A.) Conversely, the preferred arrangement of this invention permits selectively independent operation of the second clamp B. (FIG. 2B.) This has been discovered to be advantageous in connection with book markers as a single book marker in the form of the present invention may for instance be used to constantly identify, with the first clamp A for example, one location in a book, for instance the end of a chapter, while the second clamp B may be selectively independently operated to mark any given page preceding the chapter's end. In this fashion, a reader may know both exactly where he or she discontinued reading a book, as well as the location of a desired upcoming location in that same book.

It is preferred that the common hinged connection between the first 10 and second 20 jaw members, and the common hinged connection between the second 20 and third 30 jaw members, comprise separate hinged connections, as herein described, although a single common hinged connection is also contemplated. In the embodiment characterized by separate hinged connections, it is preferred that the pivot point $P_1$ defined by the hinged connection between the jaw members 20 and 30 be offset in relation to the pivot point $P_2$ defined by the hinged connection between the jaw members 10 and 20, and that the tab 33 be positioned relative to the pivot point $P_2$ between the first 10 and second 20 jaw members so that actuation of the second clamp B does not simultaneously actuate the first clamp A. In the illustrated embodiment, for instance, the tab 33 is positioned so that the force applied thereto during manual actuation of the second clamp B is directed substantially immediately above the pivot point $P_2$, it being appreciated that in this manner the force applied to the pivot point $P_2$ will not be translated into incidental angular movement of the second jaw member 20 and, hence, operation of the first clamp A.

It is also preferable, according to the present invention, that the desired suitable means used to bias the first A and second B clamps toward their respective clamped positions be at least sufficient, for the chosen lengths of the jaw portions of each clamp, to bias the clamps A, B towards their clamped positions against the bending moment of the page of an average size book. Most preferably, the biasing means are sufficient to bias the first A and second B clamps towards their closed positions against the bending moment of a plurality of pages of an average size book.

Of course, the foregoing is merely illustrative of one embodiment of the present invention; those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. A book marker, comprising: at least first, second, and third jaw members, said first and second jaw members hingedly connected at a common pivotal axis to define a first independently operable clamp selectively positionable between clamped and unclamped positions thereof, and said second and third jaw members hingedly connected at a common pivotal axis to define a second independently operable clamp selectively positionable between clamped and unclamped positions thereof, and wherein further said second jaw member comprises a central body portion having vertically spaced apart jaw and tab portions projecting oppositely from said central body portion, said tab portion operative to effect pivotal movement of said second jaw member, and said third jaw member is hingedly connected to said central body portion and projects therefrom oppositely of said tab portion.

2. The book marker of claim 1, wherein said third jaw member includes a tab portion for independently selectively actuating said second clamp between the clamped and unclamped position thereof.

3. The book marker of claim 2, wherein said common pivotal axis between said first and second jaw members, and said common pivotal axis between said second and third jaw members, comprise separate pivotal axes, said separate pivotal axes being offset relative to each other, and said tab portion for said second clamp being positioned relative to said pivotal axis between said first and second jaw members so that actuation of said second clamp does not simultaneously actuate said first clamp.

4. The book marker of claim 3, wherein said first and second clamps are biased towards the clamped positions thereof.

5. A book marker, comprising: at least first, second, and third jaw members, said first and third jaw members being directly hingedly connected to a vertically extending central body portion of said second jaw member, and said second jaw member including a jaw portion projecting from said central body portion and positioned between said first and third jaw members to define a common jaw to each of first and second clamps defined by said jaw members, and wherein each said clamp is selectively positionable between clamped and unclamped positions thereof, and wherein further said second jaw member includes a tab portion projecting from said central body portion in vertically spaced apart relation to, and oppositely of, said jaw portion so that said second jaw member is characterized by a generally "S"-shaped profile.

6. The book marker of claim 5, wherein the hinged connection between said first and second jaw members, and the hinged connection between said second and third jaw members comprise separate hinged connections, said separate hinged connections being offset relative to each other, and said third jaw member further includes a tab portion for independently selectively actuating said second clamp, said tab portion of said third jaw member being positioned relative to said hinged connection between said first and second jaw members so that actuation of said second clamp does not simultaneously actuate said first clamp.

7. The book marker of claim 6, wherein the first and second clamps are biased towards the clamped positions thereof.

8. A book marker, comprising: a first, generally planar jaw member having jaw and tab portions defined at opposite ends of said jaw member; a second jaw member having a vertically extending central body portion, and jaw and tab portions projecting oppositely from vertically spaced apart locations on said central body portion, wherein said first jaw member is pivotally connected to said central body portion, and said jaw portions of said first and second jaw members are confronting so as to define a first clamp; and a third jaw member pivotally connected to said central body portion in vertically spaced apart relation from said jaw portion of said second jaw member, said third jaw member projecting from said central body portion oppositely of said tab portion of said second jaw member, wherein said third jaw member includes a jaw portion confronting said jaw portion of said second jaw member so as to define a second clamp, and a tab portion for independently selectively actuating said second clamp.

9. The book marker of claim 8, wherein the pivotal connection between said first and second jaw members, and the pivotal connection between said second and third jaw members comprise separate pivotal connections arranged offset relative to each other, and wherein further the tab portion of said third jaw member is positioned relative to said pivotal connection between said first and second jaw members so that actuation of said second clamp does not simultaneously actuate said first clamp.

10. The book marker of claim 9, further including a biasing spring positioned between said tab portions of said first and second jaw members, said biasing spring urging said tab portions of the first and second jaw away from each other.

* * * * *

UNITED STATES PATENT AND TRADEMARK OFFICE

CERTIFICATE OF CORRECTION

PATENT NO. : 6,250,249 B1
DATED : June 26, 2001
INVENTOR(S) : Yang

It is certified that error appears in the above-identified patent and that said Letters Patent is hereby corrected as shown below:

Column 6,
Line 40, after "jaw", insert -- members --.

Signed and Sealed this

Twenty-second Day of January, 2002

*Attest:*

*Attesting Officer*

JAMES E. ROGAN
*Director of the United States Patent and Trademark Office*